United States Patent [19]

Au-Yeung

[11] Patent Number: 4,806,887

[45] Date of Patent: Feb. 21, 1989

[54] R-SWITCH WITH TRANSFORMERS

[75] Inventor: Henry Y. M. Au-Yeung, Kitchener, Canada

[73] Assignee: Com Dev Ltd., Cambridge, Canada

[21] Appl. No.: 54,524

[22] Filed: May 27, 1987

[30] Foreign Application Priority Data

Jan. 12, 1987 [CA] Canada ..... 527164

[51] Int. Cl.[4] ..... H01P 1/10

[52] U.S. Cl. ..... 333/106; 333/34

[58] Field of Search ..... 333/106, 108, 1, 125, 333/34, 35

[56] References Cited

U.S. PATENT DOCUMENTS 3,155,923 11/1964 Persson ..... 333/106 X 4,242,652 12/1980 Shishido et al. ..... 333/106

4,283,685 8/1981 MacMaster et al. ..... 333/125 X

*Primary Examiner*—Paul Gensler

*Attorney, Agent, or Firm*—Daryl W. Schnurr

[57] ABSTRACT

A waveguide R-switch has transformers in one or more of its three waveguide paths. The presence of the transformers allows the R-switch to be constructed of a smaller size than previous R-switch with curved outer paths. This results in important weight and volume savings.

19 Claims, 10 Drawing Sheets

PRIOR ART

PRIOR ART

R-SWITCH WITH TRANSFORMERS

BACKGROUND OF THE INVENTION

1. Field of the Invention

This invention relates to a microwave waveguide switch and, in particular, to an R-switch that has a transformer located in at least one of the waveguide paths.

2. Description of the Prior Art

It is known to use R-switches in communication satellites. In fact, in most satellites, numerous R-switches are employed. The size of the R-switch is important as there are so many of them used in a spacecraft and weight and volume reductions can result in large cost savings. Also, the size of the R-switch can impose restraints on a transponder layout and a reduction in size and volume of R-switches can provide extra flexibility in the layout process.

Usually, an R-switch has three waveguide paths, a straight central path and two curved E-bend waveguide paths. In a variation of existing R-switches, the two outer paths have waveguide corners instead of curved E-bends. Generally, the waveguide corner R-switch has worse isolation and return loss performance compared to the E-bend R-switch. Also, the straight waveguide in the centre path limits the amount of size reduction that can be achieved. R-switches are generally used in association with an actuator which moves the R-switch to various predetermined positions. Since there are numerous R-switches used in most communication satellites, any mass or volume saving can result in a substantial overall saving.

SUMMARY OF THE INVENTION

It is an object of the present invention to provide an R-switch for use with an actuator that can be much smaller in mass and volume than existing R-switches and still have sufficient usable bandwidth, isolation and similar return loss when compared to existing R-switches.

A waveguide R-switch in accordance with the present invention for use with an actuator has a rotor rotatably mounted within a housing. The rotor has at least three rectangular waveguide paths, each path having an 'a' dimension representing height and a 'b' dimension representing width, said dimensions determining a size of a path at a particular location. The housing has ports suitably located therein to correspond with one or more of said paths when said R-switch is in a particular position. A transformer is located within at least one of said paths, said transformer being any step reduction in the size of a waveguide path. The actuator rotates the rotor within said housing to a plurality of predetermined positions.

DESCRIPTION OF A PREFERRED EMBODIMENT

Figure 1A:
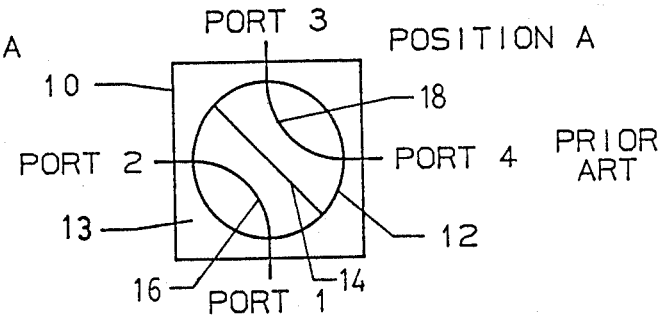
FIG. 1A is a schematic drawing of a prior art R-switch in position A.
Figure 1B:
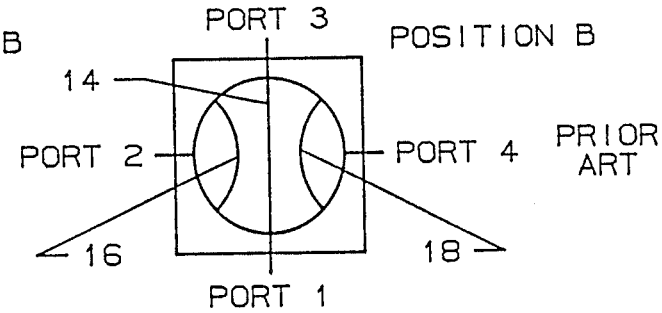
FIG. 1B is a schematic drawing of a prior art R-switch in position B.
Figure 1C:
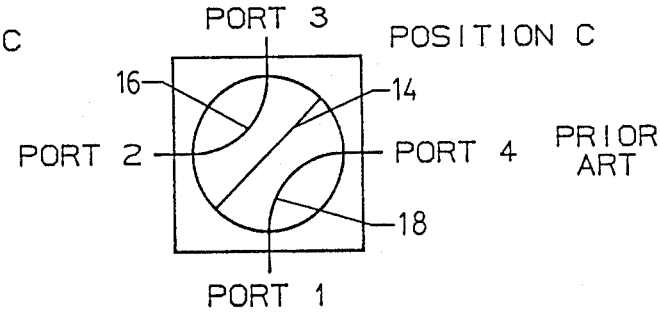
FIG. 1C is a schematic drawing of a prior art R-switch in position C.

Referring to the figures in greater detail, in FIGS. 1A, 1B, 1C and 1D, there is shown four predetermined positions of a typical R-switch 10. Most often, an R-switch is a three position switch and can be operated in the positions shown in FIGS. 1A, 1B and 1C. However, a four position switch which includes the additional position shown in FIG. 1D can also be utilized. As the drawings shown in FIGS. 1A, 1B, 1C and 1D are schematic views only, a rotor 12 is located within a housing 13 and the waveguide paths are shown with lines extending beyond the rotor representing ports 1, 2, 3, 4 of the housing 13. The R-switch 10 of FIG. 1 has three waveguide paths, a central path 14 and two outer paths 16, 18.

Figure 1D:
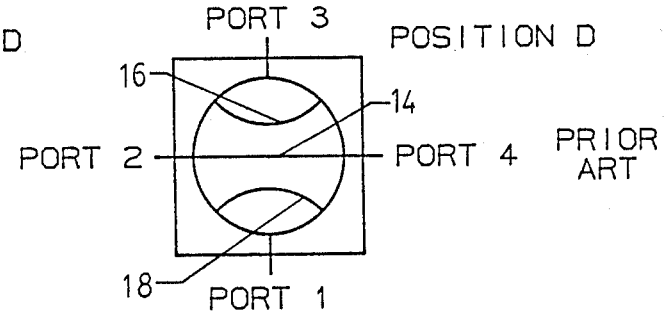
FIG. 1D is a schematic drawing of a prior art R-switch in position D.

In FIG. 1A, the R-switch 10 is in a first position A with waveguide path 16 connecting ports 1 and 2 and waveguide path 18 connecting ports 3 and 4. The central path 14 is closed off. In FIG. lB, the R-switch 10 is shown in a second position B with the waveguide path 14 connecting ports 1, 3 and the remaining paths 16, 18 being closed off. In FIG. lC, the R-switch 10 is shown in a third position C with waveguide path 16 interconnecting ports 2 and 3 and waveguide path 18 interconnecting ports 1 and 4. The remaining path 14 is closed off. In FIG. 1D there is shown an R-switch 10 in a fourth position D with waveguide path 14 interconnecting ports 2 and 4. The remaining paths 16, 18 are closed off. The first three positions are commonly used in prior art R-switches. By changing the design of the actuator or mechanical drive for rotating the rotor in a housing, a four position R-switch having all four of the positions discussed above can be utilized. The R-switch of the present invention can be utilized as a three position R-switch or a four position R-switch.

Figure 2:
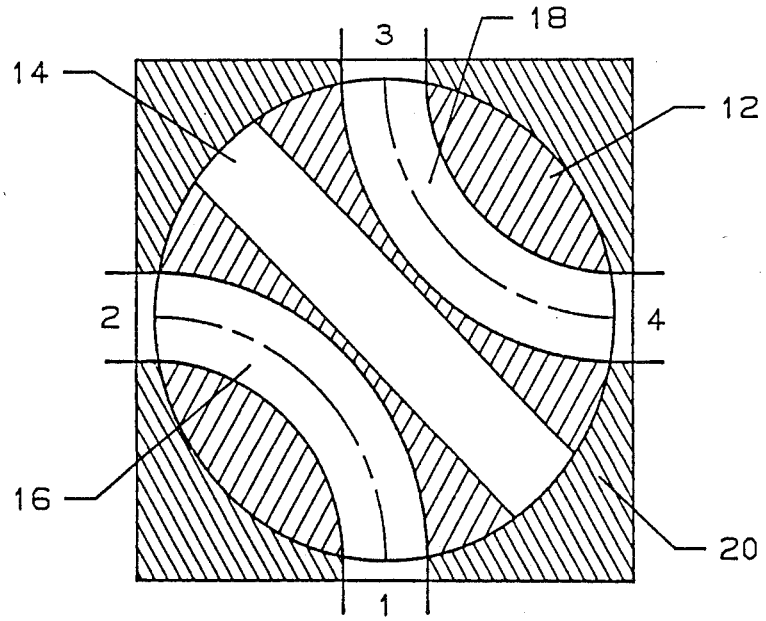
FIG. 2 is a sectional top view of a standard prior art R-switch having two E-bend waveguide paths.

In FIG. 2, there is shown a sectional top view of a prior art R-switch 10 having a rotor 12 rotatably mounted within a housing 20. The R-switch has a central waveguide path 14 and two outer waveguide paths 16, 18. The outer waveguide paths have what is referred to as an E-bend. While the R-switch 10 of FIG. 2 is shown in a first position, the R-switch could be activated to any predetermined position.

Figure 3:
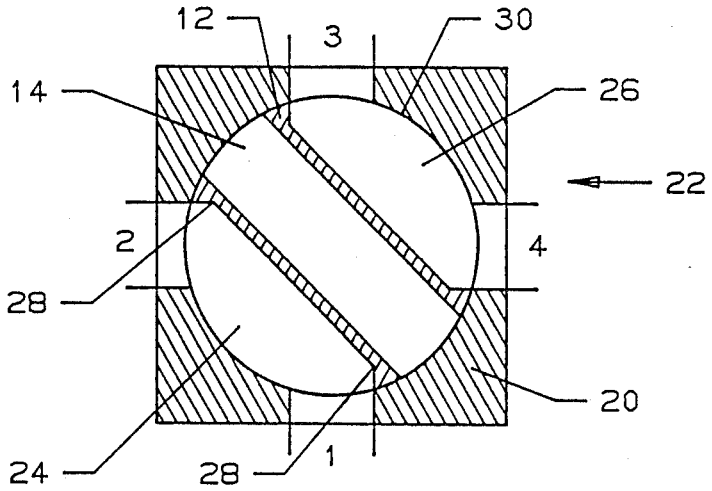
PRIOR ART FIGURE 3
FIG. 3 is a sectional top view of a prior art R-switch having waveguide corners.

In FIG. 3 there is shown what is referred to in the prior art as a waveguide corner R-switch 22. The R-switch 22 is not as commonly used as the R-switch 10. It too has a rotor 12 mounted in a housing 20 with a central waveguide path 14 and two other waveguide paths 24, 26. The outer waveguide paths 24, 26 are referred to as waveguide corner paths and are different from the E-bend paths 16, 18 shown in FIG. 2. The main difference is that the paths 24, 26 are not a smooth curve but have corners 28 and are open to an interior surface 30 of the housing 20. It can readily be seen that the rotor 12 shown in FIG. 3 can be lighter and slightly smaller than the rotor 12 shown in FIG. 2. However, the R-switch 22 results in a greatly reduced isolation and worse return loss performance compared to the R-switch 10 of FIG. 2. With both prior art R-switches 10, 22, the straight waveguide in the central path 14 limits the amount of size reduction that can be achieved. The R-switch 10 provides full waveguide band operation while the R-switch 22 is operable over only a small fraction of the waveguide bandwidth. Operation of an R-switch over the full waveguide band is not required in most satellite applications. Usually, a small fraction of the waveguide bandwidth is sufficient. However, the larger the fraction, the greater the flexibility of use of the R-switch.

Figure 4:
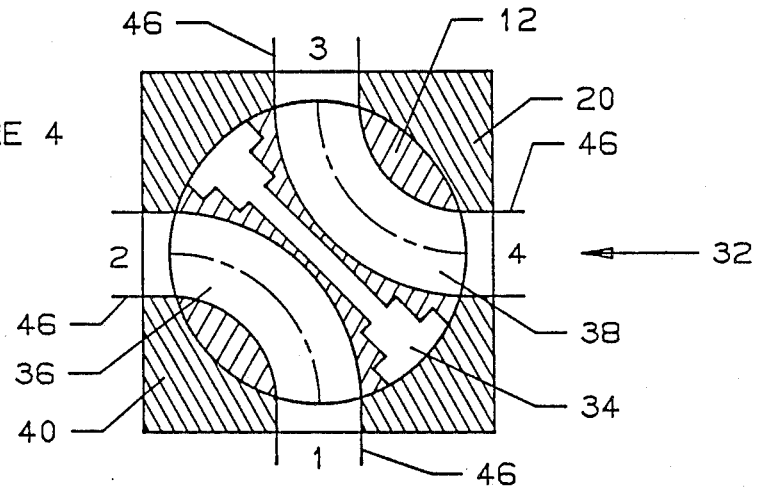
FIG. 4 is a sectional top view of an R-switch in accordance with the present invention having a transformer in a central waveguide path.

In FIG. 4, there is shown an R-switch 32 with a rotor 12 rotatably mounted within a housing 20. The rotor has at least three waveguide paths, a central path 34 and two outer paths 36, 38. The outer paths 36, 38 are E-bend paths. The housing 20 has ports 1, 2, 3, 4 suitably located therein to correspond with one or more of said paths 34, 36, 38 when said R-switch is in a particular position. The central path 34 has a three-step transformer located within it. The outer paths 36, 38 are E-bend paths. One of the ports 1, 2, 3, 4 is located in each of the four side walls 40 of the housing 20. The R-switch 32 is drawn approximately to scale relative to the R-switch 10 shown in FIG. 2 and it can readily be seen that the R-switch 32 is significantly smaller in size than the prior art R-switch 10. Each of the paths 34, 36, 38 has a 'b' dimension, being the width of the waveguide path and an 'a' dimension being the height or depth of the waveguide path.

In FIG. 4, the dimension 'b' of the waveguide path 34 is reduced in steps. This reduction in the 'b' dimension is referred to as a transformer. To obtain a good Voltage Standing Wave Ratio (henceforth VSWR) match in the frequency band of operation between switch interface waveguides 46, three waveguide 'steps' are introduced in path 34 for impedance matching. The waveguide path 34 is said to contain a three-step transformer because three sections, with a reduced 'b' dimension are inserted between the interface waveguides at either end of the path 34. The VSWR bandwidth in the path 34 after the dimensional alteration is less than the complete waveguide bandwidth. However, the transformer in the bandwidth can be designed so that it provides a good VSWR match for the particular operating frequency band of a satellite.

Figure 5:
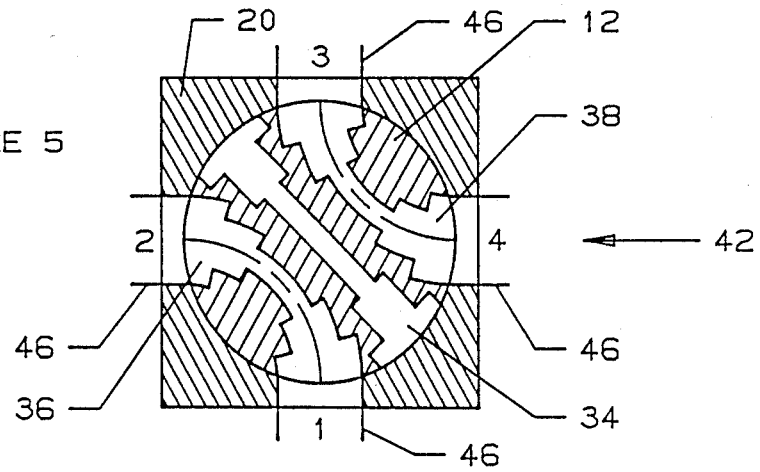
FIG. 5 is a sectional top view of an R-switch in accordance with the present invention having transformers in all three paths.

In FIG. 5, an R-switch 42 has three waveguide paths 34, 36, 38 where all three paths contain a transformer. The R-switch 42 has a three-step transformer in each of the waveguide paths 34, 36, 38. It can be seen that the 'b' dimension of the outer paths 36, 38, has been reduced in three sections between the interface waveguide at either end of each path. FIG. 5 has also been drawn approximately to scale relative to FIGS. 4 and 2 and the approximate size reduction achieved in the R-switch 42 compared to the R-switch 32 and the prior art R-switch 10 can readily be seen.

Figure 6:
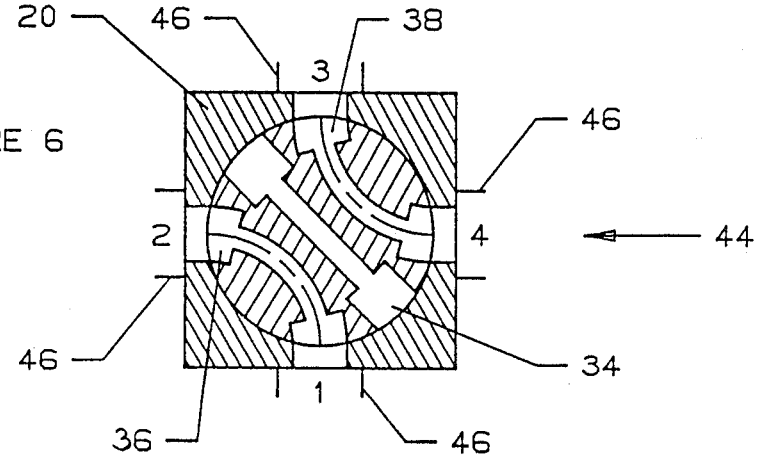
FIG. 6 is a sectional top view of an R-switch in accordance with the present invention where the transformers are located in ports of a housing.

In FIG. 6, an R-switch 44 has one waveguide step located in each of the waveguide paths 34, 36, 38. In addition, ports 1, 2, 3, 4 in the housing 20 are reduced in size and are all identical in size. It can be stated that in this manner, a transformer is integrated into the housing ports and there is actually a three-step transformer located between the interface waveguides 46 as the dimensions of the interface waveguides 46 are larger than the dimensions of the ports 1, 2, 3, 4.

The R-switch 44 is drawn approximately to scale and it can readily be seen that it is further reduced in size over the R-switches 42, 32 and the prior art R-switch 10. In FIGS. 4, 5 and 6, only the 'b' dimension has been reduced in size and the 'a' dimension of each of the waveguide paths has remained constant. Therefore, all of the transformers are homogeneous. However, the transformer concept of the present invention is equally applicable to the non-homogeneous case. For example, the size of the waveguide can be reduced by reducing only the 'a' dimension or both the 'a' and 'b' dimensions. Further, the transformers are not limited to a three-step design and the number of steps in a transformer located within a waveguide path depends solely on the bandwidth requirements. For example, a transformer or transformers could either be 1, 2, 3, 4 or 5-step transformers. While transformers having more than 5 steps are also feasible, from a practical point of view, these would not normally be utilized. Also, it is possible to have a transformer in the central waveguide path and not in the outer paths or to have transformers in each of the outer paths but not in the central path. Generally, the outer waveguide paths will be identical except that they will be mirror images of one another. Also, while the transformers discussed thus far have been symmetrical, it is possible to have asymmetrical transformers.

Figure 7A:
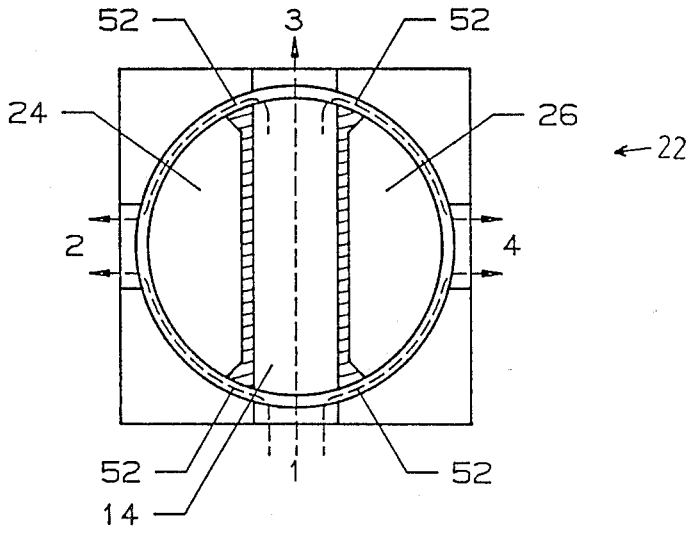
FIG. 7A is a sectional top view of a potential leakage path of a prior art R-switch having waveguide corners.
Figure 7B:
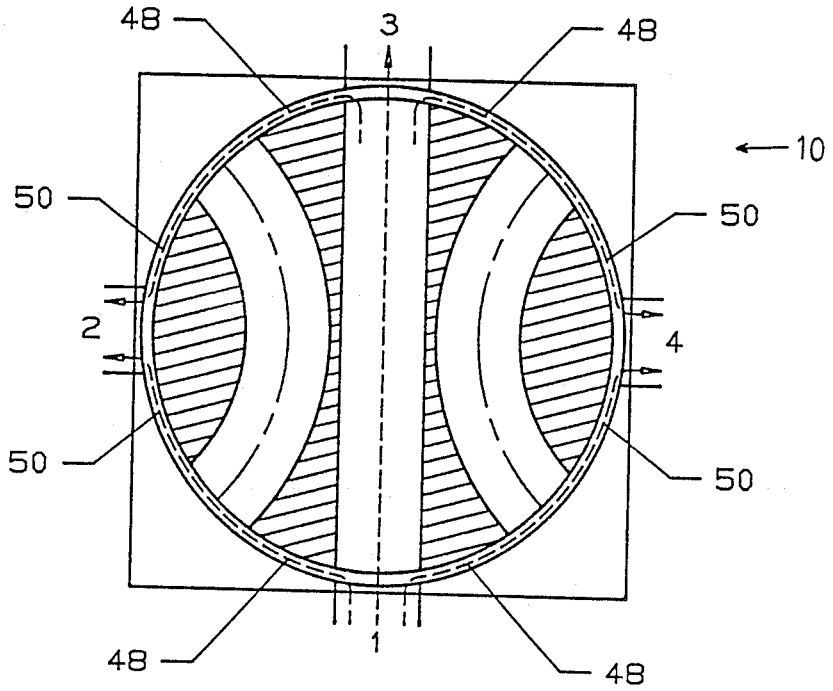
FIG. 7B is a sectional top view showing potential leakage paths of a prior art waveguide R-switch having E-bend paths.
Figure 7C:
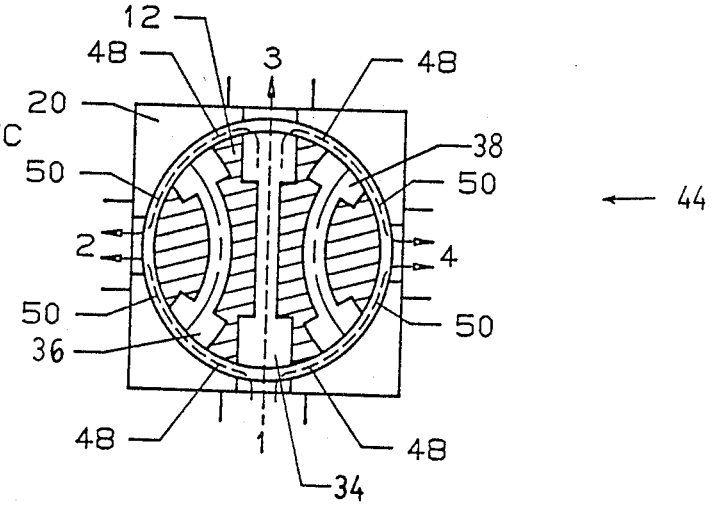
PRIOR ART FIGURE 7C
FIG. 7C is a sectional top view of potential leakage paths for an R-switch in accordance with the present invention.

An important electrical parameter for waveguide switches is the measurement of isolation performance. Isolation performance is a measurement of signal leakage into the waveguide ports that are closed off when the switch is in a particular position. It is very desirable to have a high isolation performance. Isolation performance is determined by rotor configuration, number of wavelengths between adjacent waveguide paths and the availability of space for choke sections. In FIGS. 7A, 7B and 7C there is shown a prior art R-switch 22, a prior art R-switch 10 and an R-switch 44 in accordance with the present invention respectively. All three R-switches shown are in position B as described with respect to FIG. 1. In other words, ports 1 and 3 are interconnected and ports 2 and 4 are closed off.

As can be seen from FIG. 7A, a leakage path, as shown by dotted lines on said Figure, can exist between the rotor and the housing at either end of the waveguide path 14 and into the waveguide paths 24, 26 and the ports 2, 4. With the R-switch 10 shown in FIG. 7B, a leakage path is also shown between the rotor and the housing by dotted lines. However, unlike the R-switch 22 it can be seen that the leakage path of the R-switch 10 must overcome two low impedance waveguide sections 48, 50 of the rotor 12 before leaking into the ports 2, 4. With the R-switch 22, only one low impedance section 52 of the rotor 12 must be overcome for the signal to leak from the path 14 to the ports 2, 4. Thus, the R-switch 10 would be expected to have a higher isolation response than the R-switch 22.

The R-switch 44 shown in FIG. 7C also has a signal leakage path to ports 2, 4 shown by dotted lines. It can readily be seen that the signal must overcome low impedance sections 48, 50 of the rotor 12 in order to leak from the path 34 to the ports 2, 4. Even though the low impedance sections 48, 50 of the rotor 12 of the R-switch 44 are smaller than the corresponding sections 48, 50 of the R-switch 10, there are two sections that must be overcome rather than one section as shown for the R-switch 22. Therefore, it would be expected that the R-switch 44 would have a higher isolation response than the R-switch 22 but a lower isolation response than the R-switch 10. The reason for this is that the phase length between the centre path 34 and the outer paths 36, 38 of the rotor 44 is smaller than that for the R-switch 10.

It is known that choke sections located between two waveguide paths will result in a better isolation performance for an R-switch. Choke sections are extra short circuit stubs that are machined into the space between two adjacent waveguide paths.

Figure 8:
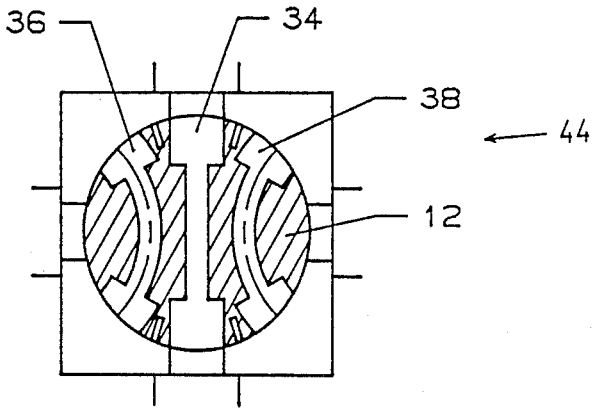
FIG. 8 is a sectional top view of a rotor with choke sections.

As shown in FIG. 8, there is sufficient space between adjacent waveguide paths to locate a choke section in an R-switch 44 of the present invention. Of course, choke sections could also be utilized with other R-switches of the present invention, for example, R-switches 32, 42. As shown in Table 1 below, the performance, mass and size of a WR 75 waveguide R-switch used in the Ku band in accordance with the prior art E-bend R-switch 10, prior art waveguide corner R-switch 22 and an R-switch 44 in accordance with the present invention. Choke sections were utilized in the following R-switches:.

| | Prior Art E-bend R-switch 10 | Prior Art Waveguide Corner R-switch 22 | R-switch Having Transformers in Accordance With R-switch 44 of FIG. 6 |
|---|---|---|---|
| Bandwidth | 5000 MHz | 500 MHz | 1000 MHz |
| Isolation | 80 dB | 35 dB | 60 dB |
| Return Loss | >30 dB | >30 dB | >30 dB |
| Rotor Diameter | 1.8 in | 1.3 in | 1.0 in |
| Switch Size | (2.0) (2.0) (3.5") | (1.6) (1.6) (3.2") | (1.2) (1.2) (2.7") |
| Mass | 260 grams | 180 grams | 130 grams |

Figure 9:
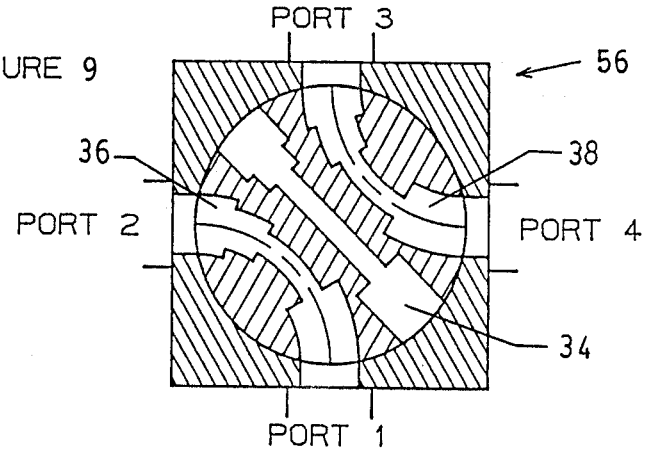
FIG. 9 is a sectional top view of an R-switch having a four-step transformer.
Figure 10:
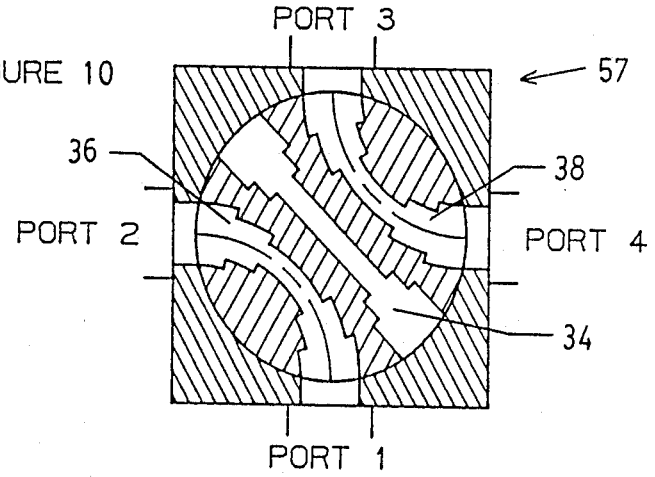
FIG. 10 is a sectional top view of an R-switch having a five-step transformer.

It can readily be seen from the Table that while the R-switch of the present invention has a much smaller bandwidth than the prior art R-switch 10, it is much greater than the bandwidth of the prior art R-switch 22. Similarly, it can be seen that the isolation performance of the R-switch 44 in accordance with the present invention is much greater than the isolation performance of the prior art R-switch 22, though somewhat less than the isolation performance of the prior art R-switch 10. However, the rotor diameter and size or volume of the R-switch in accordance with the present invention is much smaller than either of the prior art R-switches. Further, the mass of the R-switch 44 is greatly reduced from that of either of the prior art R-switches. In FIG. 9, there is an R-switch 56 with a four-step transformer. This transformer is asymmetrical. In FIG. 10, there is shown an R-switch 57 with a five-step transformer.

Figure 11:
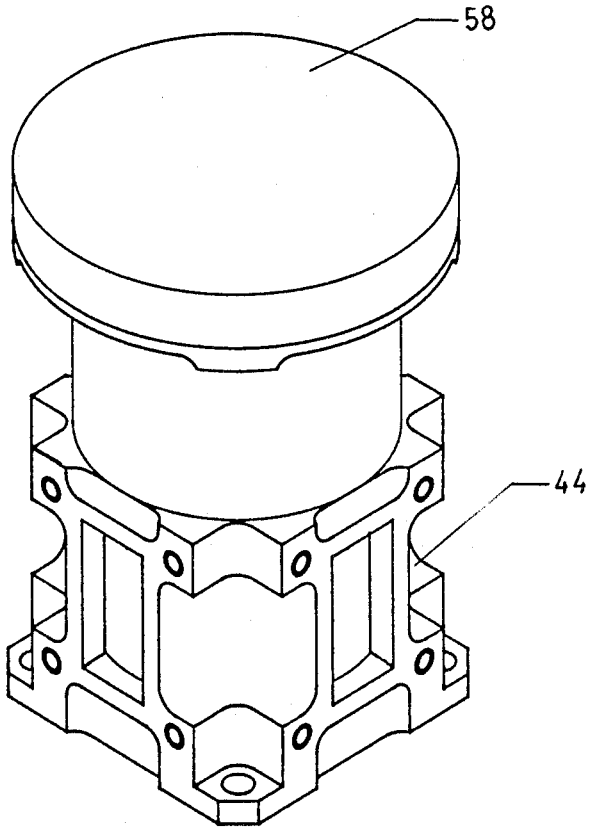
FIG. 11 is a perspective view of an R-switch and an actuator.

In FIG. 11, there is shown a perspective view of an R-switch in accordance with the present invention with an actuator 58 located thereon. The actuator 58 provides means for rotating the rotor to positions A, B, C as shown in FIG. 1. If the actuator is suitably designed, the R-switch can be a four position R-switch and can also include position D. Since the actuator mass constitutes approximately 30% to 40% of the total switch mass, it is as important to reduce the actuator mass as it is to reduce the rotor and housing mass of the R-switch. Fortunately, any reduction in the mass of the rotor automatically leads to a reduction in the actuator mass as the size and mass of the actuator is determined by the drive torque required to rotate the rotor. The fact that the actuator can be reduced in size increases the mass and volume savings for the use of an R-switch in accordance with the present invention.

Figure 12:
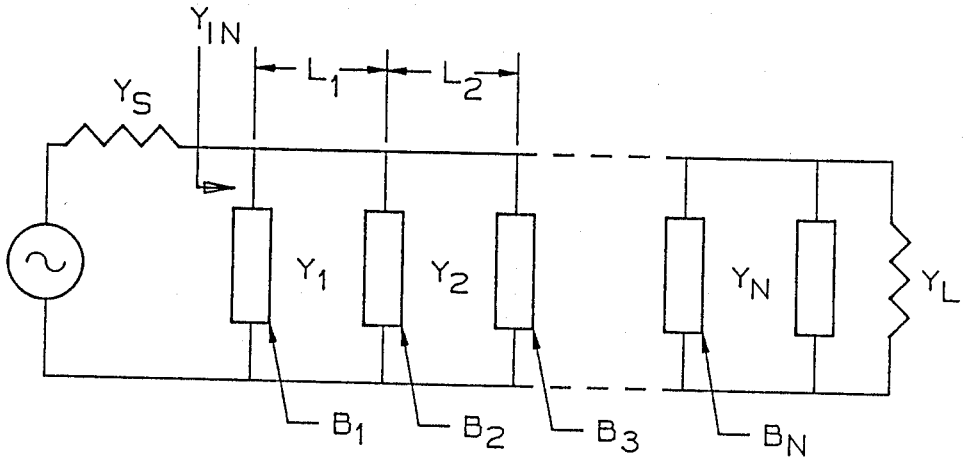
FIG. 12 is a circuit diagram of a transformer model.

In FIG. 12, there is shown a transformer model that is used to provide a good correlation between physical dimensions of the transformers and the electrical performance required. Any change in waveguide dimensions are represented by corresponding changes in transmission line admittances. The junction susceptances $B_1$, $B_2$, $B_3$, . . . $B_n$ are always taken into account during the design stage. The values of these junction susceptances can be found in many publications. The junction model that is utilized in this design can be found in Marcuvitz's Waveguide Handbook, published by McGraw-Hill Book Company Inc., 1951, by N. Marcuvitz PP. 307–310.

The reflection coefficient can be computed from the following equation:

$$p = \frac{Y_s^* - Y_{in}}{Y_s + Y_{in}}$$

where $Y_s$ is the source admittance $Y_s^*$ is the complex conjugate of Y $Y_{in}$ is the input admittance of the transformer It is found that this model gives a very accurate prediction of the RF performance. There may be other junction models that could be used to design the transformers in accordance with the present invention. The design procedure set out herein is only one method of designing the transformers and is not intended to limit the invention in any way.

Having established the transformer model, it is then necessary to determine the optimum dimensions for a given frequency band under the dimensional constraints of the rotor. This is performed by numerical optimization techniques.

A two-stage optimization algorithm is required to determine the transformer dimensions. Stage 1 optimizes the curve transformer dimensions subject to the rotor dimensional constraints. Stage 2 optimizes the straight transformer dimensions subject to both the rotor and curve transformer dimensional constraints.

Figure 13:
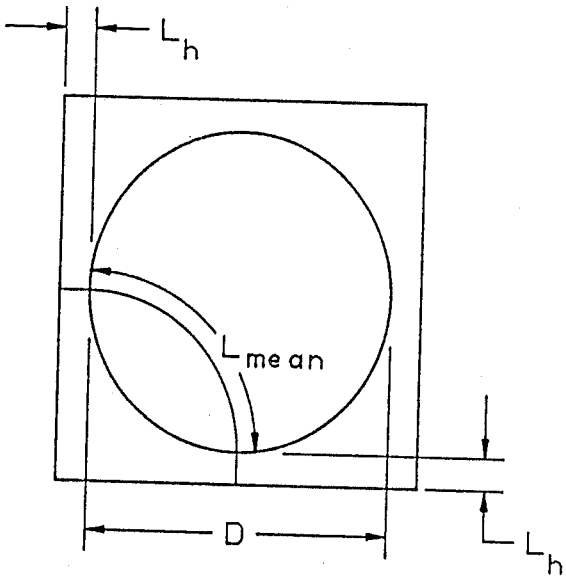
FIG. 13 is a schematic view of certain dimensions for an R-switch of the present.

The parameters are defined as follows:

nc: total number of sections in the curved transformer;

ns: total number of sections in the straight transformer;

m: number of frequency points;

$ac_i$: 'a' dimension of waveguide section 'i' in the curved transformer;

$bc_i$: 'b' dimension of waveguide section 'i' in the curved transformer;

$lc_i$: length of waveguide section 'i' in the curved transformer;

$ac_i$ max: max 'a' dimension of waveguide section 'i' in the curved transformer;

$bc_i$ max: max 'b' dimension of waveguide section 'i' in the curved transformer;

$lc_i$ max: max length of waveguide section 'i' in the curved transformer;

$as_i$: 'a' dimension of waveguide section 'i' in the straight transformer;

$bs_i$: 'b' dimension of waveguide section 'i' in the straight transformer;

$ls_i$: length of waveguide section 'i' in the straight transformer;

$as_i$ max: max 'a' dimension of waveguide section 'i' in the straight transformer;

$bs_i$ max: max 'b' dimension of waveguide section 'i' in the straight transformer;

$ls_i$ max: max length of waveguide section 'i' in the straight transformer;

p: reflection coefficient at frequency point j;

$L_{mean}$: mean path length of curved transformer in rotor;

Lh: housing dimension (refer to FIG. 13);

D: rotor diameter.

---

1st Stage Optimazation $$\text{Min } [\max p_k (ac_i, bc_i, lc_i)] \qquad i = 1,2, \ldots nc \quad k = 1,2, \ldots m$$

subject to:

$$lc_1 + lc_2 + \ldots + lc_{nc} = L_{mean} + 2^*L_h$$
$$bc_i < bc_i \max$$
$$ac_i < ac_i \max$$

Solution: $ac_i$, $bc_i$, $lc_i$ $\qquad i = 1,2, \ldots nc$

2nd Stage Optimization $$\text{Min } [\max p_j as_i, bs_i, ls_i)] \qquad i = 1,2, \ldots ns \quad j = 1,2, \ldots m$$

subject to:

$$ls_1 + ls_2 + \ldots + ls_{ns} = D + 2^*L_h$$
$$bs_1 = bc_1$$
$$bs_{ns} = bc_{nc}$$
$$as_1 = ac_1$$
$$as_{ns} = ac_{nc}$$
$$as_i < as_i \max$$
$$bs_i < bs_i \max$$

Solution: $as_i$, $bs_i$, $ls_i$ $\qquad i = 1,2, \ldots ns$

---

Other methods of designing the transformers will be readily apparent to those skilled in the art.

Figure 14:
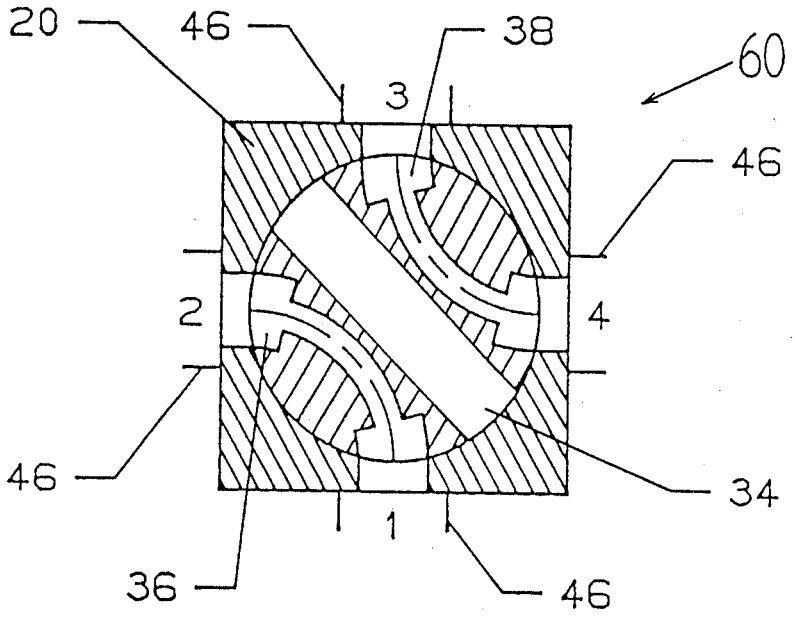
FIG. 14 is a sectional top view of an R-switch in accordance with the present invention where there is a transformer in the two outer paths but there is no transformer in the centre path.

FIG. 14 shows an R-switch 60 with a rotor 12 rotatably mounted within a housing 20. The rotor has three waveguide paths, a central path 34 and two outer paths 36, 38. The R-switch 60 is similar to the R-switch 44 of FIG. 6 except that the central path 34 does not contain a transformer. Therefore, the same reference numerals are used for the components of the R-switch 60 as those used for the R-switch 44 and the R-switch 60 is not further discussed.

What I claim as my invention is:

1. A waveguide R-switch for use with an actuator, said R-switch comprising a rotor rotatably mounted within a housing, said rotor having at least three rectangular waveguide paths, each path having an 'a' dimension representing height and a 'b' dimension representing width, said dimensions determining a size of a path at a particular location, said housing having ports suitably located therein to correspond with one or more of said paths when said R-switch is in a particular position, with a transformer located within at least one of said paths, said transformer being any step reduction in the size of a waveguide path, said actuator being means to rotate said rotor within said housing to a plurality of predetermined positions.

2. A waveguide R-switch as claimed in claim 1 wherein the size of a waveguide path is determined by a change in the 'b' dimension only.

3. A waveguide R-switch as claimed in claim 2 wherein said housing has four side walls with one port in each wall, said ports being numbered 1 to 4 in a clockwise direction, the waveguide paths of said rotor being located relative to said ports so that:

(a) in a first position, one path interconnects ports 1 and 2 and third path interconnects ports 3 and 4;

(b) in a second position, one path interconnects ports 1 and 3 and the remaining two paths are closed off;

(c) in a third position, one waveguide path interconnects ports 2 and 3 and another waveguide path interconnects ports 1 and 4.

4. A waveguide R-switch as claimed in claim 3 wherein there is a centre path and two outer paths, the other paths being mirror images of one another, but otherwise being identical.

5. A waveguide R-switch as claimed in any one of claims 1, 2 or 3 wherein there is a transformer located in the centre path but not in the two outer paths.

6. A waveguide R-switch as claimed in any one of claims 1, 2 or 3 wherein there is a transformer in the two outer paths but not the centre path.

7. A waveguide R-switch as claimed in any one of claims 1, 2 or 3 wherein there is a transformer located in all three paths.

8. A waveguide R-switch as claimed in claim 4 wherein there is a transformer in all three paths.

9. A waveguide R-switch as claimed in any one of claims 1, 2 or 8 wherein there is a two-step transformer in at least one of the paths.

10. A waveguide R-switch as claimed in any one of claims 1, 2 or 8 wherein there is a three-step transformer in at least one of the paths.

11. A waveguide R-switch as claimed in any one of claims 1, 2 or 8 wherein there is a four-step transformer in at least one of the paths.

12. A waveguide R-switch as claimed in any one of claims 1, 2 or 8 wherein there is a five-step transformer in at least one of the paths.

13. A waveguide R-switch as claimed in any one of claims 1, 2 or 8 wherein one transformer is symmetrical.

14. A waveguide R-switch as claimed in any one of claims 1, 2 or 8 wherein one transformer is asymmetrical.

15. A waveguide R-switch as claimed in any one of claims 1, 2 or 8 wherein the ends of each of the waveguide paths have identical dimensions.

16. A waveguide R-switch for use with interface waveguides as claimed in any one of claims 1, 2 or 8 wherein the ports of the housing have dimensions that are identical to dimensions of the ends of the rotor waveguide paths, said dimensions being smaller than dimensions of the interface waveguides so that a transformer from the waveguide paths is integrated into each of the housing ports.

17. A waveguide R-switch as claimed in any one of claims 1, 2 or 8 wherein the cross-sectional area of the switch, including the housing, normal to the axis of rotation of the rotor is less than 1.5 square inches.

18. A waveguide R-switch as claimed in any one of claims 1, 2 or 8 wherein a space in the rotor between ends of two adjacent waveguide paths contains choke sections.

19. A waveguide R-switch as claimed in any one of claims 1, 2 or 8 wherein in position 4, ports 2 and 4 are interconnected and the other two waveguide paths are closed off.

* * * * *